US005302135A

United States Patent [19]

Lee

[11] Patent Number: 5,302,135

[45] Date of Patent: Apr. 12, 1994

[54] ELECTRICAL PLUG

[76] Inventor: Feng-Jui Lee, 4F-1, No. 92, Kuang-Hua S. St., Hsin Chu City, Taiwan

[21] Appl. No.: 15,230

[22] Filed: Feb. 9, 1993

[51] Int. Cl.[5] ..... H01R 13/15

[52] U.S. Cl. ..... 439/263

[58] Field of Search ..... 439/259, 263, 801, 806, 439/851

[56] References Cited

U.S. PATENT DOCUMENTS 1,987,772 1/1935 Eberhardt ..... 439/263

3,041,572 6/1962 Solinsky ..... 439/263

3,296,575 1/1967 Neidecker ..... 439/263

*Primary Examiner*—Larry I. Schwartz

*Assistant Examiner*—Khiem Nguyen

[57] ABSTRACT

Disclosed is an electrical plug having contact tubes retained between a top shell and a bottom shell by an adjusting binding screw and two washers, and a plate spring retained between the top shell and one washer, wherein turning the adjusting binding screw inwards causes the top and bottom shell to squeeze the split front end of each contact tube in reducing its diameter for positive contact.

1 Claim, 3 Drawing Sheets

ELECTRICAL PLUG

BACKGROUND OF THE INVENTION

The present invention relates to electrical plugs of the type having contact tubes for connecting contact pins of an electrical socket. More particularly, the present invention relates to an electrical plug which can be adjusted to reduce the diameter of the contact tubes for positive contact.

FIGS. 1 and 2 illustrate an electrical plug having contact tubes on the inside for connecting contact pins of an electrical socket. This structure of electrical plug is generally comprised of a top shell and a bottom shell connected together by binding screws, and contact tubes respectively connected to an electric wire and firmly retained between the top and bottom shells on the inside. The contact tubes may be expanded after long uses. When either contact tube was expanded, its diameter is relatively increased. Once the diameter of either contact tube was increased, a contact error tends to happen. When a contact error occurs, the electrical plug shall be detached and properly repaired.

In view of the aforementioned problem, the inventor has addressed the objective of adjusting the diameter of the contact tubes of an electrical plug by turning an adjusting binding screw without the necessity of detaching the assembly.

SUMMARY OF THE INVENTION

The present invention provides an electrical plug, which is consisted of a top shell connected a bottom shell by an adjusting binding screw and washers, two contact tubes inserted in grooves between the top and bottom shells and respectively connected to an electric wire, each of which having a split front end for receiving a respective contact pin of an electrical socket, and a plate spring retained to the adjusting binding screw between one washer and the top shell. By turning the adjusting binding screw inwards, the contact tubes are squeezed by the top and bottom shells to reduce the diameter of the respective split front end for positive contact.

DETAILED DESCRIPTION OF THE PREFERRED EMBODIMENT

Figure 1:
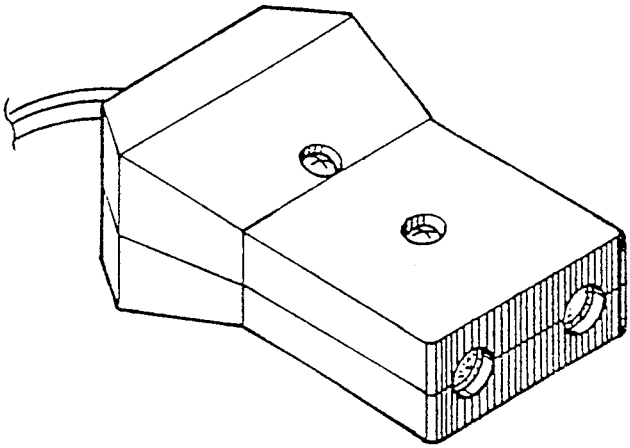
PRIOR ART FIG 1
FIG. 1 is an elevational view of an electrical plug according to the prior art.
Figure 2:
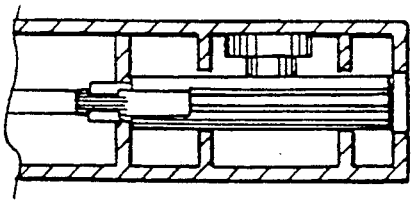
PRIOR ART FIG 2
FIG. 2 illustrates the internal structure of the electrical plug of FIG. 1.
Figure 3:
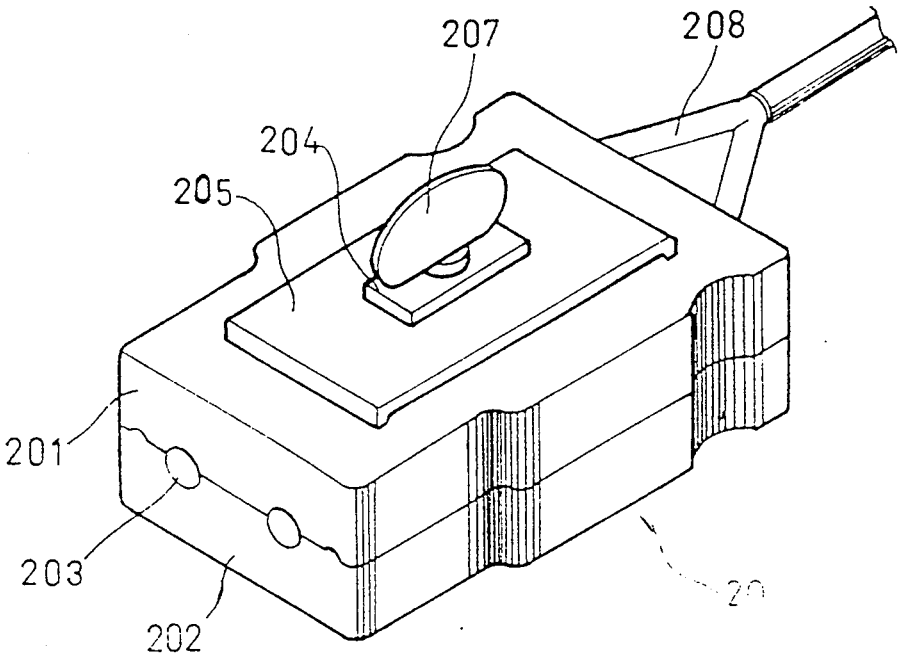
FIG. 3 is an elevational view of an electrical plug according to the present invention.
Figure 4:
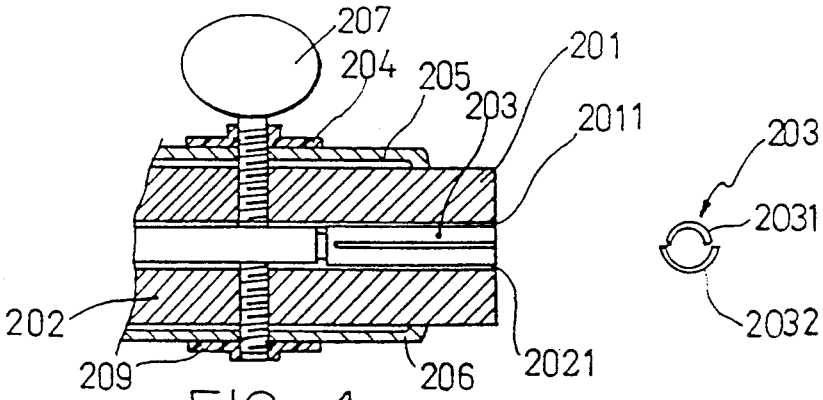
FIG. 4 is a partly sectional side view of the electrical plug of FIG. 3 and a front end view of one contact tube before squeezing.
Figure 5:
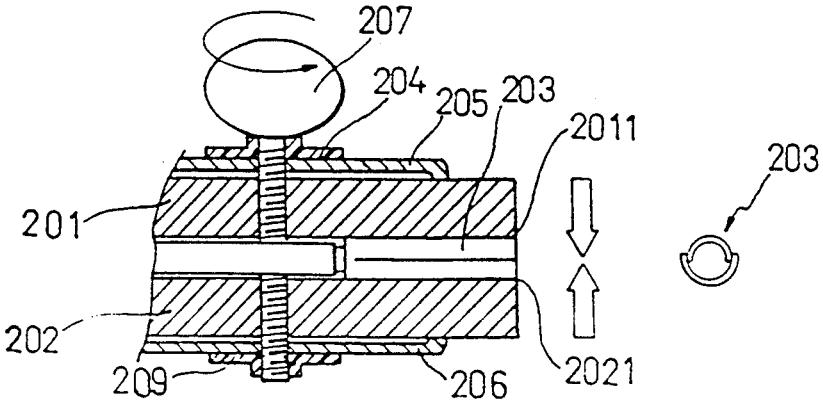
FIG. 5 illustrates the diameter of the split front end of each contact tube reduced.
Figure 6:
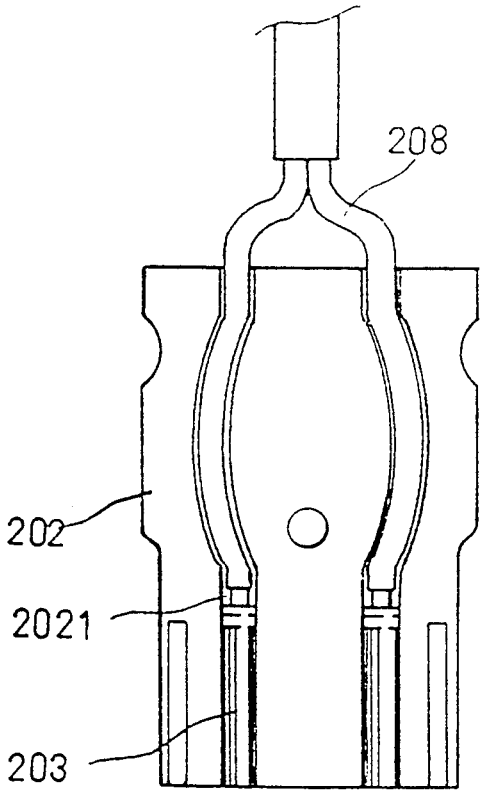
FIG. 6 is a top view showing the two contact tubes respectively inserted in the grooves on the shells and connected to the electric wire.

Referring to FIGS. 3,4,5 and 6, an electrical plug 20 as constructed in accordance with the present invention is generally comprised of a top shell 201, a bottom shell 202, two contact tubes 203, a first washer 204, a plate spring 205, a second washer 206, an adjusting binding screw 207, and an electric wire 208.

The top and bottom shells 201,202 have each two parallel grooves 2011 or 2021 on a respective flat inside wall, which receive the contact tubes 203 as the top and bottom shells 201,202 are connected together. The contact tubes 203 are identical, having each a rear end connected to the black or white wire of the electric wire 208 and a front end terminated to a split configuration formed of two opposed channel tips 2031,2032. Therefore, the diameter of the hole of each contact tube 203 within the opposed channel tips 2031,2032 can be reduced squeezing the opposed channel tips 2031,2032 against each other.

As soon as the contact tubes 203 have been respectively connected to the electric wire 208 and retained in the grooves 2011,2021 between the top and bottom shells 201,202, the adjusting binding screw 207 is inserted in proper order through center holes (not shown) on the first washer 204, plate spring 205, top shell 201, bottom shell 202 and second washer 206 and then locked with a locknut (not shown). If the electrical plug 20 is not firmly retained in place after it was inserted into an electrical socket on an electrical appliance with the contact pins of the electrical socket respectively inserted into the contact tubes 203, the adjusting binding screw 207 is turned inwards to reduce the gap between the channel tips 2031,2032 (see FIG. 5), and therefore the contact pins of the electrical socket will become firmly and respectively retained to the contact tubes 203.

What is claimed is:

1. An electrical plug comprising:

a top shell having two parallel grooves on a flat bottom wall thereof;

a bottom shell having two parallel grooves on a flat top wall thereof respectively connected to the parallel grooves on said top shell;

an adjusting binding screw inserted through center holes on said top and bottom shells to bind up said top and bottom shells together;

two contact tubes inserted in said parallel grooves and retained between said top and bottom shells, each contact tube having a rear end connected to an electric wire and a front end for receiving a respective contact pin of an electrical socket;

a first washer fastened to said top shell on the outside by said adjusting binding screw;

a plate spring retained between said top shell and said first washer;

a second washer fastened to said bottom shell on the outside by said adjusting binding screw; and wherein each contact tube has a split front end, the diameter of the split front end being reduced by turning said adjusting binding screw inwards.

* * * * *